US005461828A

United States Patent [19]

Jordal

[11] Patent Number: 5,461,828

[45] Date of Patent: Oct. 31, 1995

[54] AWING WINDOW WITH LOCK

[76] Inventor: Robert L. Jordal, Rte. 10, Box 351, Winston-Salem, N.C. 27127

[21] Appl. No.: 297,049

[22] Filed: Aug. 29, 1994

[51] Int. Cl.[6] ..... E06B 7/086

[52] U.S. Cl. ..... 49/90.1; 49/394

[58] Field of Search ..... 49/90.1, 74.1, 49/51, 64, 394; 454/221, 278, 224

[56] References Cited

U.S. PATENT DOCUMENTS

| | | | |
|---|---|---|---|
| 1,431,619 | 10/1922 | Atkinson | 49/90.1 X |
| 2,209,568 | 7/1940 | Kavanaugh | 49/90.1 X |
| 2,798,263 | 7/1957 | Hardy | 49/90.1 X |
| 3,030,671 | 4/1962 | Jones | 49/90.1 X |
| 4,813,183 | 3/1989 | Jordal | 49/74 |
| 4,855,716 | 8/1989 | Jordal | 340/550 |
| 5,282,514 | 2/1994 | Felcetto | 49/90.1 X |

*Primary Examiner*—Philip C. Kannan

[57] ABSTRACT

The invention herein provides a key operated locking device for utilization with an awning window. The locking device allows the building occupant to fix the rotatable panels in an open posture to assist in preventing vandals and burglars from entering the premises by further opening the rotatable panels. The locking device includes a removable key and a latch which can be rotated into a slot which is positioned in the slide bar of the crank mechanism.

12 Claims, 3 Drawing Sheets

AWING WINDOW WITH LOCK

BACKGROUND OF THE INVENTION

1. Field of the Invention

The invention herein pertains to awning windows as are conventionally used in houses and other buildings and particularly pertains to a locking mechanism to provide additional security to the window while it is an open posture.

2. Background and Objectives of the Invention

Awning windows have been the standard for years in tropical climates where air conditioning is unavailable or too expensive and where breezes are commonplace. In recent years crime rates have dramatically increased in many residential areas requiring homeowners to completely close their awning windows at night and at other times such as when they are away from the premises. This has placed a burden on home and building owners and has increased the inconvenience of awning windows while limiting their intended use for ventilation purposes. Conventional awning windows generally utilize an extruded aluminum frame having one or more rotatable window panels which include pin locks which secures each panel when totally shut. In recent years lateral frame members have been added to span the frame width between the panels to assist in security by limiting the opening a burglar or vandal can exploit. However, additional security is warranted for even the most modern awning windows, especially in high crime areas and it is one objective of the present invention to provide an awning window which includes a locking device that allows the window panels to be locked in a somewhat open posture.

It is still another objective of the present invention to provide a locking device which is relatively inexpensive and can be easily adapted to conventional awning window manufacturing techniques.

It is also an objective of the present invention to provide a locking device which will securely latch the crank mechanism which drives the rotatable window panel.

It is also an objective of the present invention to provide a locking device for awning windows which includes a removable key.

Various other objectives and advantages of the present invention will become apparent to those skilled in the art as a more detailed description is set forth below.

SUMMARY OF THE INVENTION

The aforesaid and other objectives are realized by providing a locking device for positioning within the frame of a conventional awning window. The locking device includes a conventional rotatable cylinder lock which is key operated and which includes a latch member which can be manually pivoted by turning the key to engage a slot within a slide bar of the crank mechanism which rotates the window panels. Thus, with the key inserted in the cylinder lock, the key is turned thereby pivoting the latch member into a locking position within the latch slot of the slide bar. The key is removed and the so-positioned latch prevents further motion of the slide bar and hence prevents panel rotation. The crank mechanism will not operate with the slide bar locked and accordingly, the panels will not rotate. The panels can be locked in a suitable, slightly open position which will allow some air flow but will not allow the panels to be cranked further open, thus preventing unauthorized entry by intruders. One or more slots can be placed in the slide bar for selective locking the window panels in various slightly open positions for security purposes.

DETAILED DESCRIPTION OF THE PREFERRED EMBODIMENT OF THE INVENTION

Figure 1:
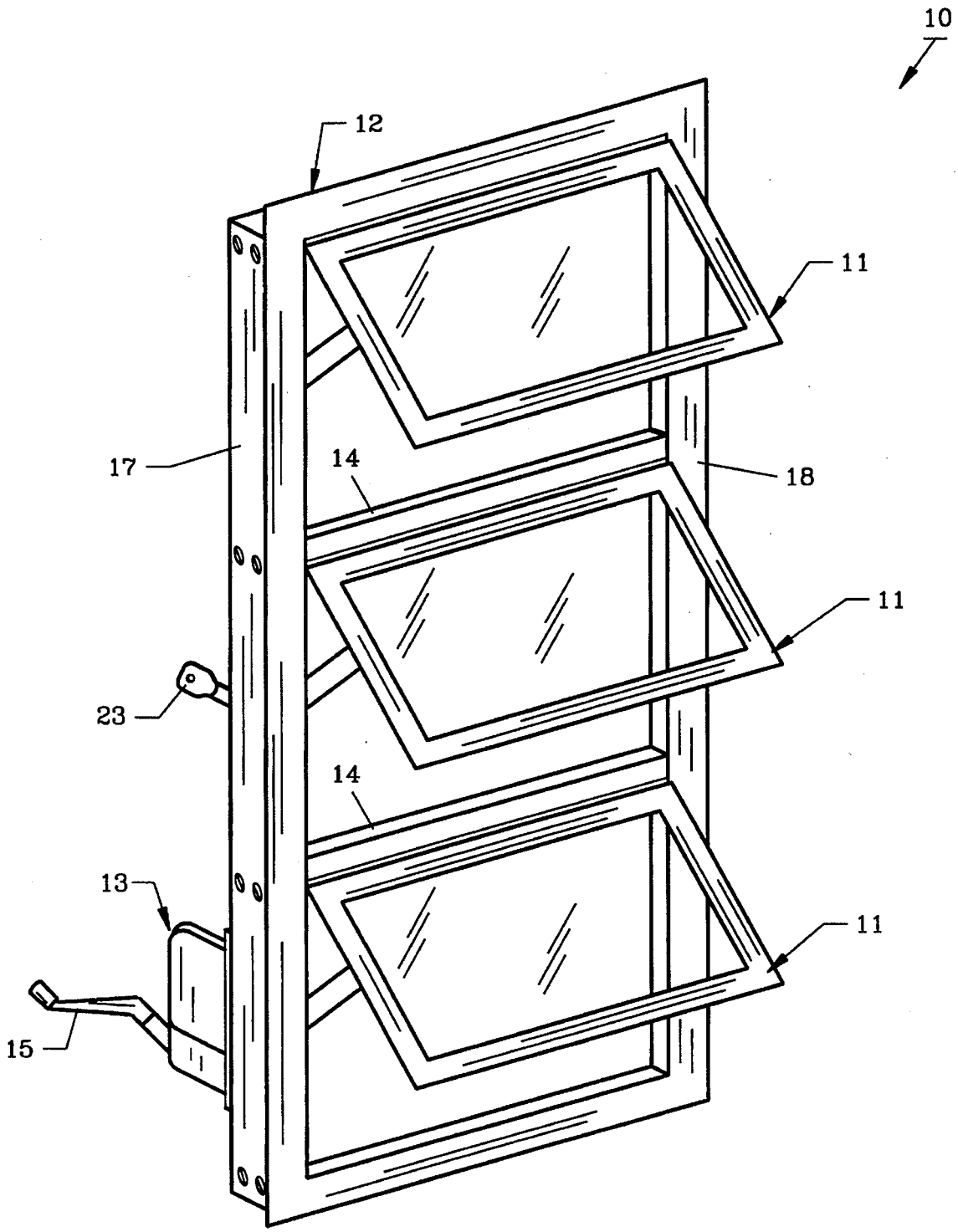
FIG. 1 illustrates an awning window of the invention with the panels opened approximately 45°.

For a more complete understanding of the invention and its operation, turning now to the drawings, FIGS. 1–4 illustrate the preferrred form of the invention. In FIG. 1, awning window 10 is shown which consists of three rotatable window panels 11 contained within extruded aluminum frame 12. Crank mechanism 13 as is well known in the industry is affixed to frame 12 for selectively, manually opening and closing panels 11 as desired. Lateral frame members 14 as shown in FIG. 1 between panels 11 provide rigidity and assist in adding security to awning window 10 as they limit the space for entry by a burglar. Lateral members 14 may be reinforced with steel rods or the like. Awning window 10 is generally equipped with one or more screens to prevent insect entry when panels 11 are opened. However, such screens (not shown) can be easily cut with a knife whereupon a burglar's hand can reach crank handle 15 and panels 11 can be fully opened for unlawful entry purposes. Sometimes burglars, upon finding awning windows with handle 15 removed, often use a substitute handle which they may carry on their person for such purposes, or they may use pliers or a similar tool to rotate crank mechanism 13. Once crank mechanism 13 opens panels 11 sufficiently, they quickly enter and burglarize or vandalize the building interior.

Figure 2:
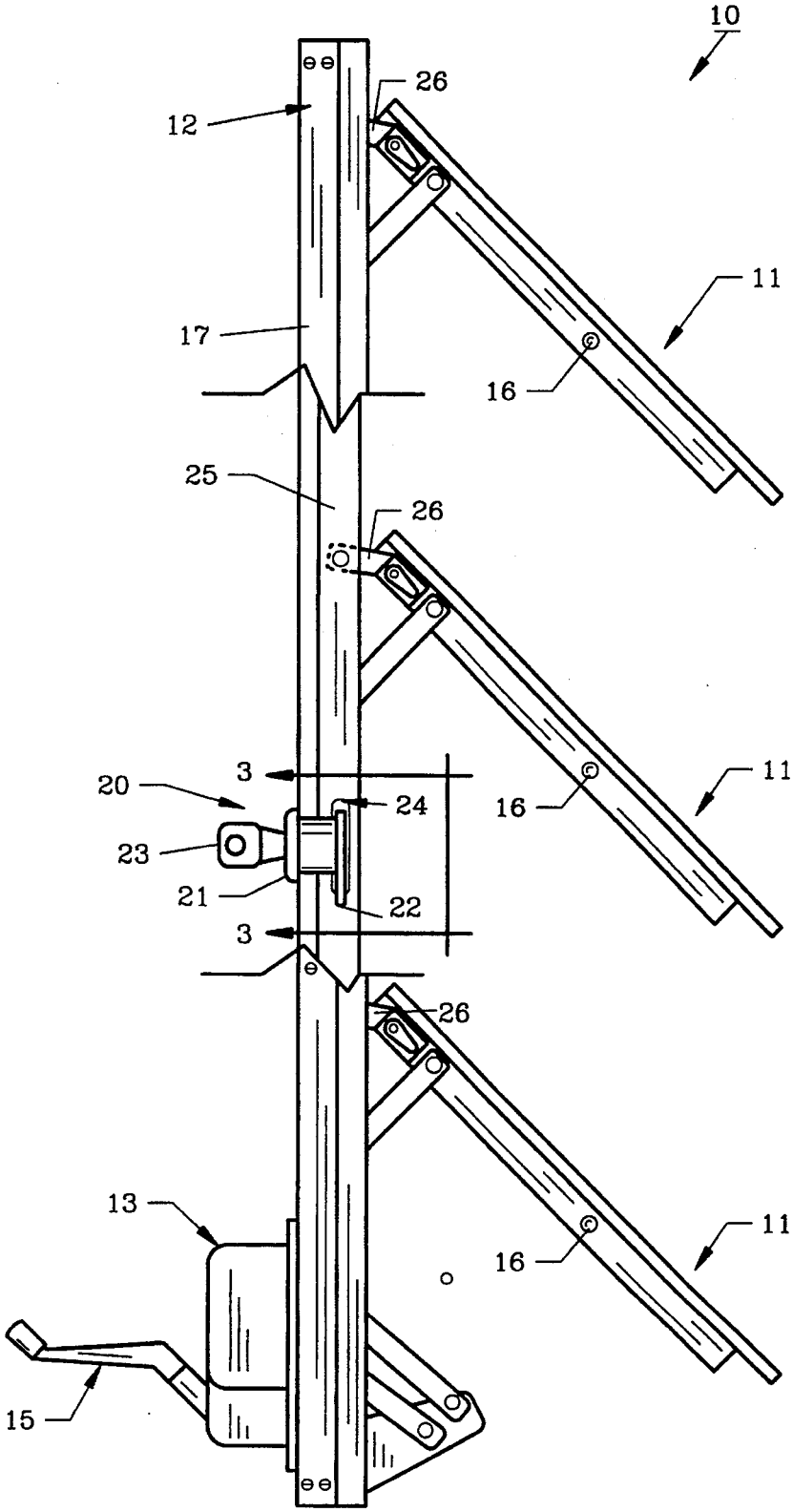
FIG. 2 shows a partial cut-away side view of the awning window as seen in FIG. 1 to clearly illustrate the locking device.
Figure 3:
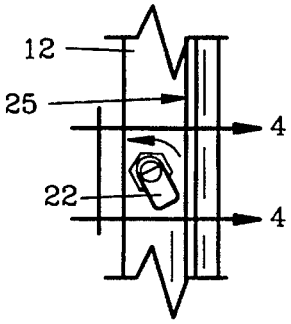
FIG. 3 demonstrates a view of the locking device as seen along lines 3—3 of FIG. 2.
Figure 4:
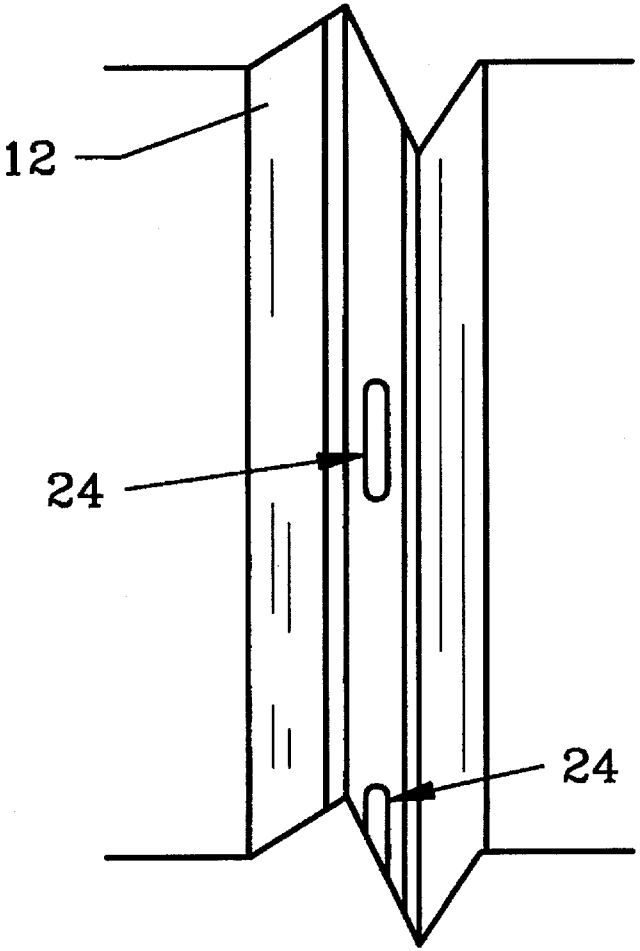
FIG. 4 shows a cut-away view of the slide bar but without the cylinder lock latch as seen along lines 4—4 of FIG. 3.

Hundreds of thousands of dollars worth of property are stolen and/or vandalized in warm climate regions which predominately use awning type windows. With increasing crime, locking device 20 as shown in FIG. 2 can be added during manufacturing processes to conventional awning windows to prevent many burglaries, lootings and the like. As seen, locking device 20 includes a standard cylinder lock 21 with a rotatable latch 22 affixed and shown in an unlocked position in FIGS. 2 and 3. Latch 22 can be rotated with key 23 inserted to pivot latch 22 into latch slot 24 of slide bar 25 as further seen in FIGS. 2, 3 and 4 to lock slide bar 25 in place. With key 23 removed, latch 22 remains stationary within latch slot 24. By reinserting key 23 in locking device 20, and by manually rotating key 23, latch 22 can be disengaged from slide bar 25 and thereafter handle 15 rotated to open or close panels 11 as desired. Slide bar 25 comprises a flat metal bar contained within frame 12 which is conventionally moved up and down by rotating crank mechanism 13 by turning handle 15. As would be understood, slide bar 25 is pivotally joined to panel struts 26 causing panel 11 to rotate as slide bar 25 moves upwardly or downwardly as desired. As shown in FIG. 3, latch 22 rotates into or out of latch slot 24 of slide bar 25 as also seen in FIG. 4. Latch slot 24 is positioned along slide bar 25 to fall directly beneath latch 22 when panels 11 are opened approximately 45° from window frame 12. However, other positionings are possible or desirable when other window sizes, shapes and openings are used. For example, on larger awning windows having larger panel heights than those shown in FIG. 2, a latch slot in the slide bar may be positioned to fall beneath latch 22 when the window panels are opened only 25° to provide a relatively small window opening. In addition, slide bar 25 could be constructed to have a plurality of latch slots therein for selectively locking panels 11 in a variety of different openings or postures. Slide bar 25 may have three latch slots positioned to lock panels 11 in positions of 15°, 30° and 45° relative to frame 12. As hereinbefore stated, slide bar 25 is part of the conventional awning window hardware as is well known and commonly used in the industry. Locking device 20 supplements and increases the security of an awning window when combined with standard lateral frame members 14 and panel locking pins 16 as shown in FIG. 2 to provide safety and security to those homeowners and the like.

As further seen in FIG. 2, locking device 20 is mounted within the left jamb member 17 of window frame 12 approximately midway between the middle and lower window panels 11. However, locking device 20 could be positioned in any of a variety of locations along left jamb member 17, right jamb member 18 or elsewhere as would be convenient for the user.

The illustrations and examples provided herein are for explanatory purposes and are not intended to limit the scope of the appended claims.

I claim:

1. An awning window comprising: a jamb member, a slide bar, said slide bar slidably received within said jamb member and in parallel alignment therewith, a window panel pivotally joined to said slide bar, said slide bar defining a latch slot, a rotatable cylinder lock, said cylinder lock mounted on said jamb member, said cylinder lock comprising a rotatable latch, said window panel pivotable from a parallel closed position to an angularly disposed open position with said jamb member, said latch rotatable to engage said latch slot when said window panel is angularly disposed to said jamb member to prevent movement of said slide bar.

2. The awning window of claim 1 wherein said cylinder lock comprises a removable key.

3. The awning window of claim 2 wherein said removable key is removable from said cylinder lock when said latch is engaged with said latch slot.

4. The awning window of claim 1 wherein said latch protrudes from said slide bar when engaged with said latch slot.

5. The awning window of claim 1 wherein said awning window comprises a plurality of window panels.

6. The awning window of claim 1 wherein said latch is normal to said slide bar when engaged with said latch slot.

7. The awning window of claim 1 wherein said latch is engaged within said latch slot when said window panel is angularly disposed at an approximate 45 degree angle to said jamb member.

8. The awning window of claim 1 wherein said slide bar defines a plurality of latch slots.

9. A security awning window comprising: a jamb member, a slide bar, said slide bar received within said jamb member and in parallel alignment therewith, said slide bar defining a latch slot, a window panel, said window panel pivotally joined to said slide bar for angular disposition therewith, a cylinder lock, said cylinder lock mounted in said jamb member proximate said slide bar, said cylinder lock comprising a rotatable latch and a removable key for rotating said latch, said latch for reception by said slide bar latch slot to prevent slide bar movement within said jamb member during angular disposition of said window panel.

10. The security awning window of claim 9 wherein said received latch protrudes from said slide bar.

11. The security awning window of claim 9 wherein said received latch is normal to said slide bar.

12. The security awning window of claim 9 wherein said key is removable from said cylinder lock with said latch within said latch slot.

* * * * *